US011627805B2

(12) United States Patent
English et al.

(10) Patent No.: US 11,627,805 B2
(45) Date of Patent: Apr. 18, 2023

(54) SHELVING APPARATUS AND SYSTEMS

(71) Applicant: PATIO LAB INC., Squamish (CA)

(72) Inventors: Joe English, Squamish (CA); Cameron Shute, Nelson (CA); Bruce Fitz-Earle, Nelson (CA)

(73) Assignee: PATIO LAB INC., Squamish (CA)

( * ) Notice: Subject to any disclaimer, the term of this patent is extended or adjusted under 35 U.S.C. 154(b) by 0 days.

(21) Appl. No.: 17/729,186

(22) Filed: Apr. 26, 2022

(65) Prior Publication Data

US 2022/0346550 A1 Nov. 3, 2022

Related U.S. Application Data

(60) Provisional application No. 63/182,309, filed on Apr. 30, 2021.

(51) Int. Cl.

| | |
|---|---|
| ***A47B 96/00*** | (2006.01) |
| ***A47B 96/07*** | (2006.01) |
| ***A47B 96/06*** | (2006.01) |

(52) U.S. Cl.

CPC ..... *A47B 96/07* (2013.01); *A47B 96/061* (2013.01)

(58) Field of Classification Search

None

See application file for complete search history.

(56) References Cited

U.S. PATENT DOCUMENTS

| | | | | |
|---|---|---|---|---|
| 2,749,072 | A * | 6/1956 | Long | E06B 9/264 248/312.1 |
| 4,059,248 | A | 11/1977 | Kuntz | |
| 5,368,267 | A | 11/1994 | Howard | |
| 5,452,875 | A | 9/1995 | Kern | |
| 5,738,319 | A | 4/1998 | Grassi | |
| 7,229,056 | B2 | 6/2007 | Rosser et al. | |
| 10,561,242 | B1 * | 2/2020 | Ignacio | A47B 57/04 |
| 2003/0052073 | A1 | 3/2003 | Dix | |
| 2006/0236896 | A1 | 10/2006 | Heroux | |
| 2009/0001235 | A1 | 1/2009 | Freudenberger | |
| 2017/0202374 | A1 * | 7/2017 | Kressin | A45D 42/00 |
| 2019/0335135 | A1 * | 10/2019 | Massey | F16M 13/02 |

FOREIGN PATENT DOCUMENTS

| | | | | |
|---|---|---|---|---|
| CA | 2308838 | A1 | 12/2000 | |
| DE | 202006011707 | U1 | 11/2006 | |
| EP | 0334770 | A1 | 9/1989 | |
| EP | 0307153 | B1 | 12/1992 | |
| EP | 2594166 | A2 | 5/2013 | |
| KR | 20160003981 | U | 11/2016 | |
| WO | WO-2021077541 | A1 * | 4/2021 | A47B 96/061 |

* cited by examiner

*Primary Examiner* — Steven M Marsh

(57) ABSTRACT

A shelving apparatus made of a frame that can be removably attached to the upward portion of a barrier structure with a support extending outwardly from the upward attachment so as to maintain different angles of the support relative to the ground and to be operable to move the downward attachment in a range of motion between positions forward and rearward of the upward of dimensions of different barrier structures.

29 Claims, 17 Drawing Sheets

SHELVING APPARATUS AND SYSTEMS

TECHNICAL FIELD

Aspects of this disclosure relate generally to shelving apparatus and systems. Particular aspects related to shelving apparatus and systems that may be easily mounted on a barrier structure.

BACKGROUND

Spending time in outdoor spaces is a way for people to relax. Many people decorate their outdoor spaces with planter boxes, potted plants, statues, wind chimes and other items that are attractive and help with relaxation. People enjoy eating and entertaining outdoors with friends, and use amenities like barbeques, outdoor dining equipment and shelving for organization. The same is true for people having balconies or enclosed patio areas.

Because of their unique shapes and sizes, it can be difficult to decorate some outdoor spaces with planters in a reliable and aesthetically pleasing manner. Hangers are available for supporting planters from overhead, but these are typically inoperable with fences and/or railings. Some planter boxes may include a frame for supporting them on fences and/or railings, but these typically lack any means for adjustment. Other common items, such as air conditioners, may include structural elements that are only capable of supporting them on a generally flat surface like a wall.

Further improvements are required to enhance the enjoyment of outdoor spaces.

BRIEF DESCRIPTION OF THE DRAWINGS

The accompanying drawings, which are incorporated in and constitute part of this disclosure, illustrate exemplary aspects that, together with the written descriptions, serve to explain the principles of this disclosure. Numerous aspects are shown conceptually in the drawings and particularly described, pointed out, and taught in the written descriptions. Some structural and operational aspects may be better understood by referencing the written portions together with the accompanying drawings, of which.

Figure 1:
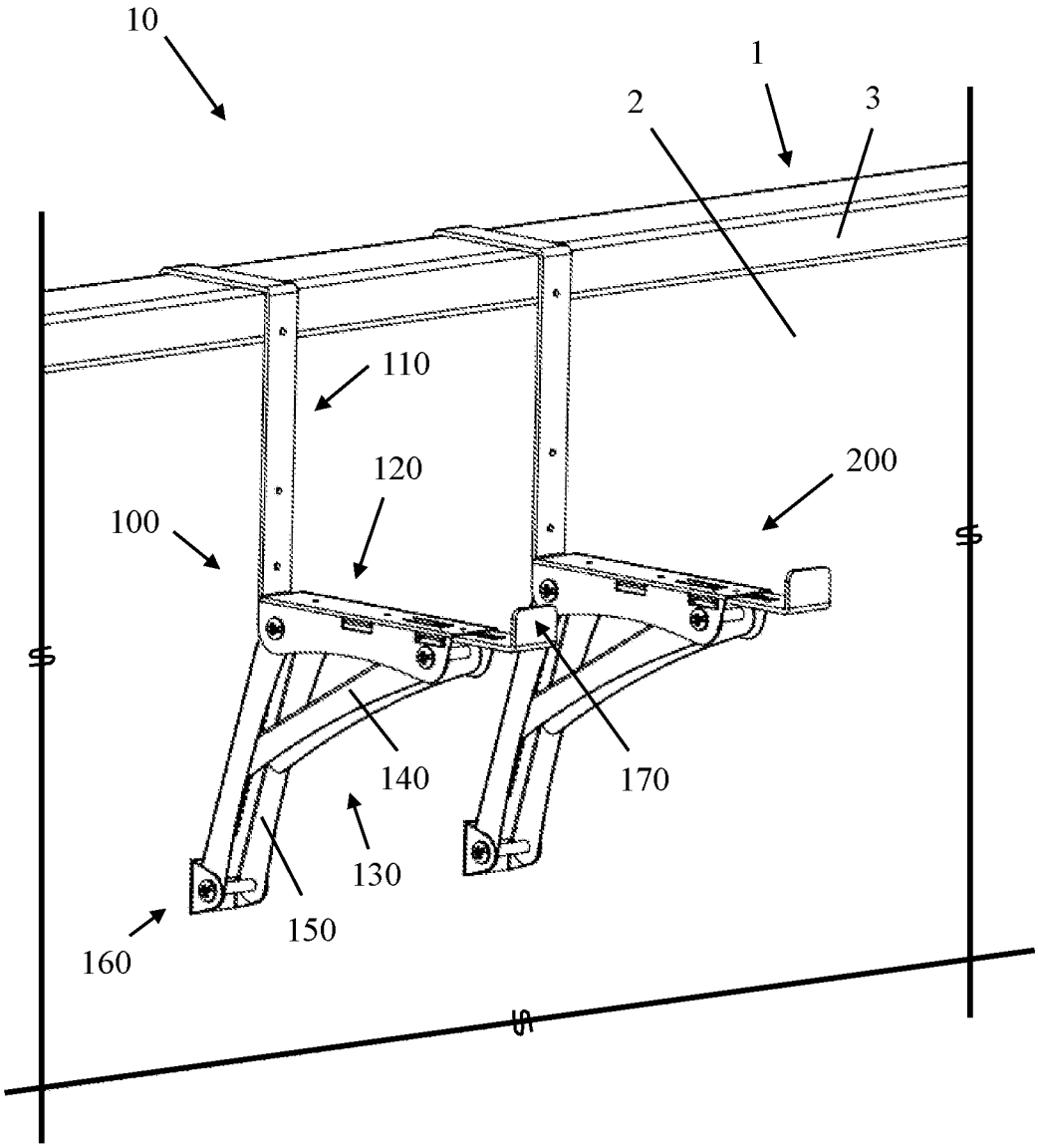
FIG. 1 depicts a perspective view of an exemplary shelving system including a first exemplary shelving apparatus and a second exemplary shelving apparatus on a barrier structure.

Aspects of the examples illustrated in the drawings may be explained further by way of citations to the drawing and element numbers in the text of the description. The drawings and any citations thereto are provided for illustration purposes, and to further clarify the description of the present disclosure and are not intended to limit the present disclosure unless claimed.

DETAILED DESCRIPTION

Aspects of the present disclosure are not limited to the exemplary structural details and component arrangements described in this description and shown in the accompanying drawings. Many aspects of this disclosure may be applicable to other aspects and/or capable of being practiced or carried out in various variants of use, including the examples described herein.

Throughout the written descriptions, specific details are set forth to provide a more thorough understanding to persons of ordinary skill in the art. For convenience and ease of description, some well-known elements may be described conceptually to avoid unnecessarily obscuring the focus of this disclosure. In this regard, the written descriptions and accompanying drawings should be interpreted as illustrative rather than restrictive, enabling rather than limiting.

Exemplary aspects of this disclosure are shelving apparatus and systems. Some aspects are described with reference to particular structures (e.g., a frame) having elements movable relative to one another (e.g., arms) for attachment to a barrier structure (e.g., fences or rails). Unless claimed, these descriptions are provided for convenience and not intended to limit this disclosure.

Accordingly, any aspects described with reference to these examples may be similarly utilized with any comparable shelving apparatus and systems.

Several exemplary reference axes are depicted, including a horizontal axis X-X, a vertical axis Y-Y, and a lateral axis Z-Z. Some elements and/or movements may be described relative to one or more of these reference axes. For example, a fence or rail may comprise vertical supports (e.g., posts) extending vertically along axis Y-Y and horizontal supports (e.g., railings) extending horizontally therebetween along axis X-X, establishing a plane X-Y. As a further example, different portions of the vertical and horizontal supports may have different and/or irregular cross-sectional shapes dimensions along lateral axis Z-Z relative to plane X-Y. Some elements may be described as "elongated," meaning that they have a length greater than a width along one or more of these reference axes. Various directions, forces, and movements are similarly described. These relative terms are provided for convenience and do not limit this disclosure unless claimed.

Inclusive terms such as "comprises," "comprising," "includes," "including," and variations thereof, are intended to cover a non-exclusive inclusion, such that any shelving apparatus, system, or element thereof described as comprising a list of elements does not include only those elements but may include other elements not expressly listed and/or inherent thereto. Unless stated otherwise, the term "exemplary" means "example" rather than "ideal." Various terms of approximation may be used, including "approximately" and "generally." Approximately means "roughly" or within 10% of a stated number or outcome and generally means "usually" or more than a 50% probability of a stated number or outcome.

Terms such as "attached to," "attachable to," and "attaching" are intended to generically describe a structural connection between two or more elements. Some structural connections may be "fixedly attached" and thus non-rotatable, as when the two or more elements are formed together and cannot be rotated independently without damage. Other structural connections may be "movably attached," as when the two or more elements are coupled together by attachment elements adapted to permit relative movements of those elements (e.g., rotating, sliding, telescoping). Unless stated otherwise, generic terms such as "attach" and its equivalents may comprise any such variations.

Aspects of the present disclosure are now described with reference to an exemplary shelving system 10, shown in FIG. 1 as comprising a shelving apparatus 100 and a shelving apparatus 200 that are configured for installation on a barrier structure 1, such as a fence, railing, or similar object.

Figure 4:
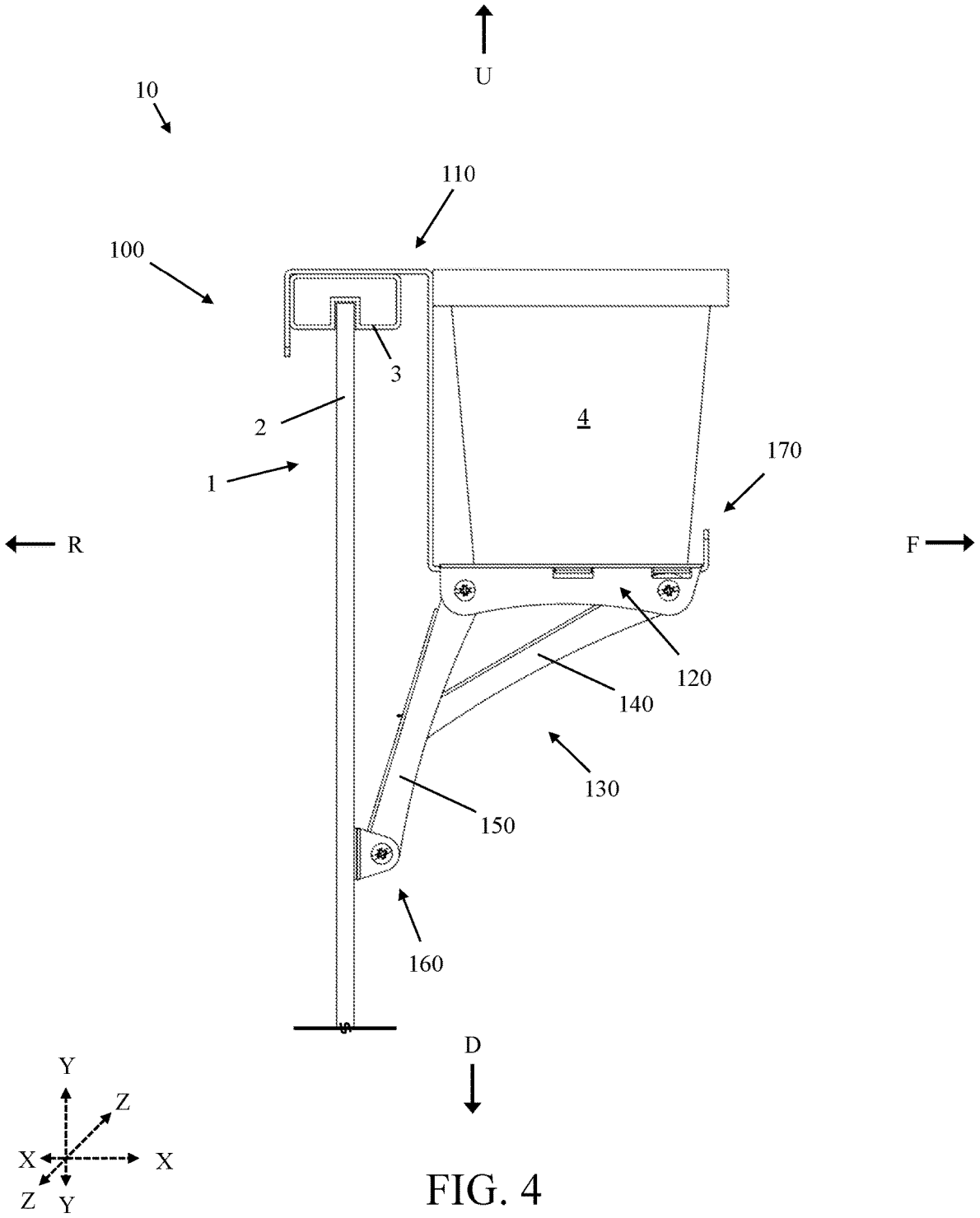
FIG. 4 depicts a side view of the FIG. 2 shelving apparatus supporting an exemplary item (e.g., a planter) on a barrier structure.
Figure 5:
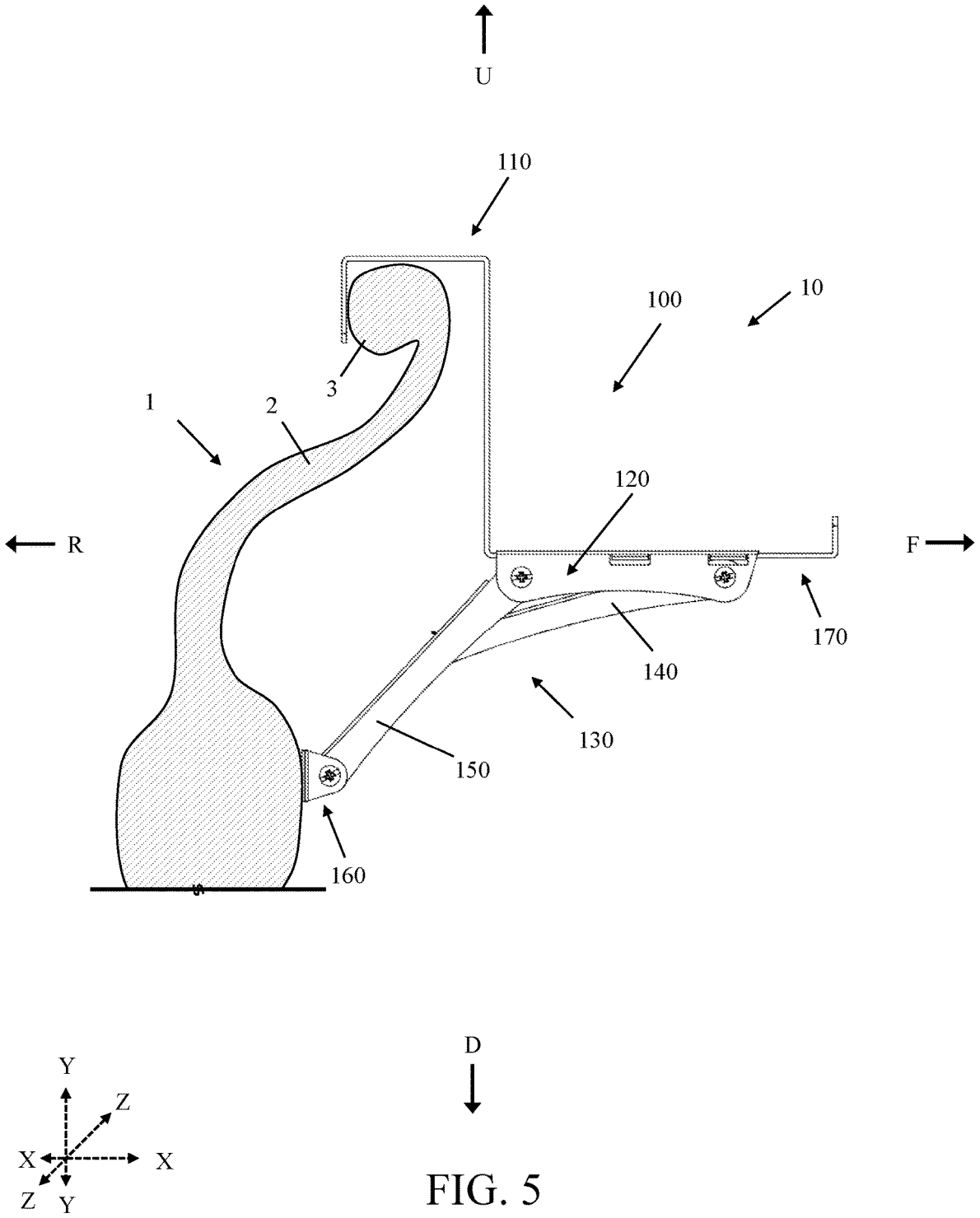
FIG. 5 depicts a side view of the FIG. 2 shelving apparatus on a different barrier structure.
Figure 6:
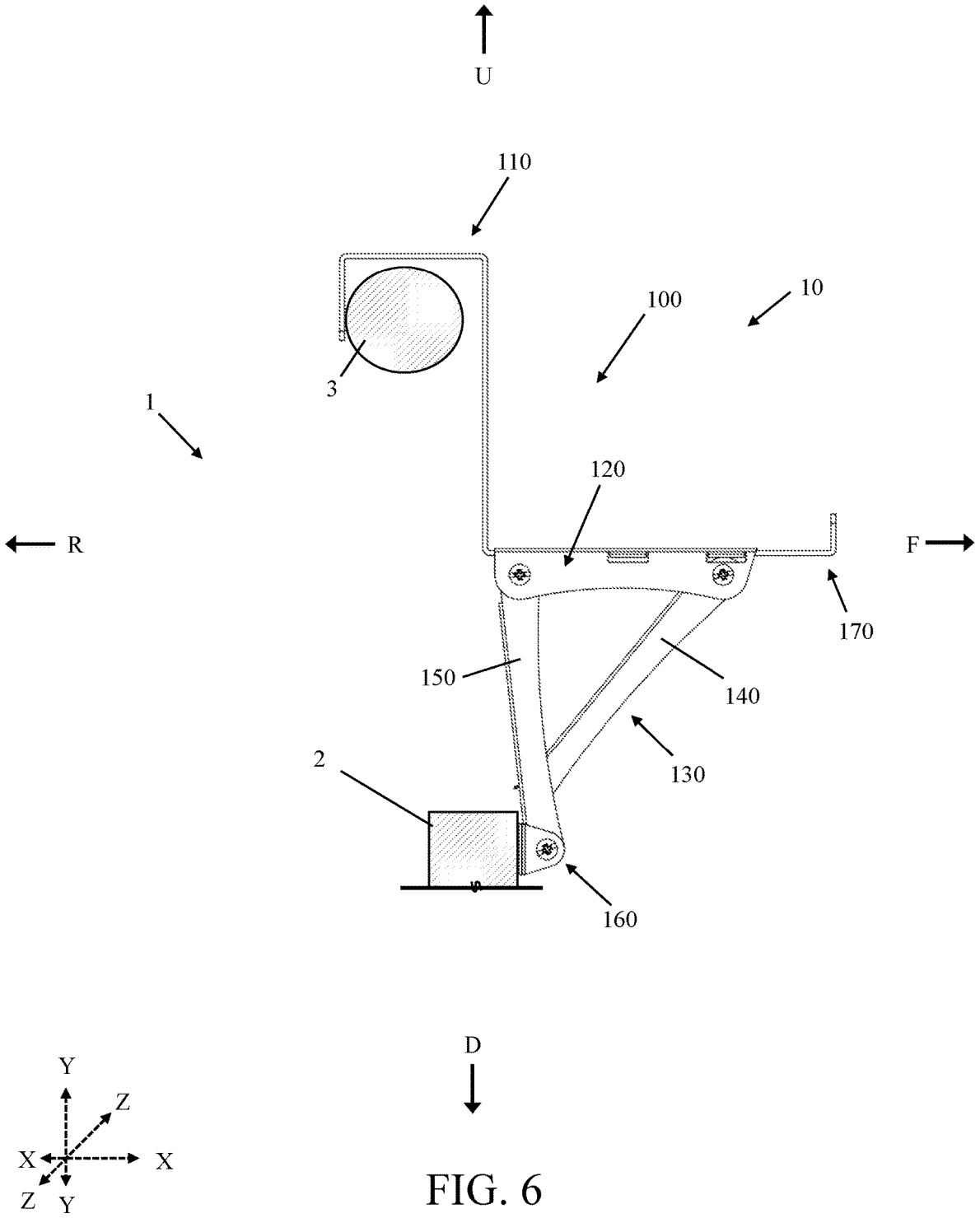
FIG. 6 depicts a side view of the FIG. 2 shelving apparatus on a different barrier structure.
Figure 7:
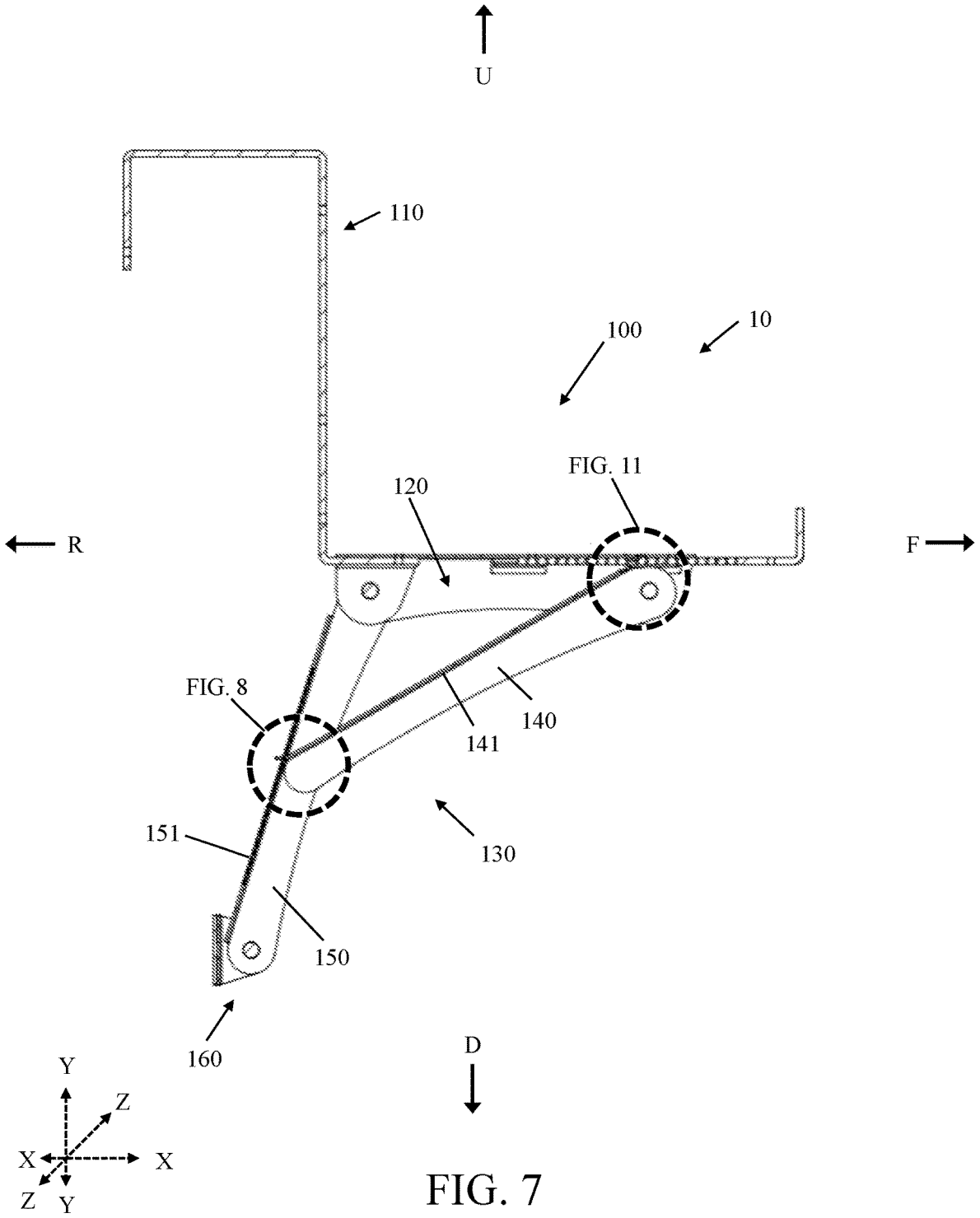
FIG. 7 depicts a cross-sectional view of the FIG. 2 shelving apparatus.

Shelving system 10 may be utilized to support an item 4 on barrier structure 1 and maintain an orientation of the item relative to the ground. As shown in FIGS. 1, 2, and 4, for example, barrier structure 1 may comprise a support body 2 shown as a tempered glass panel and a railing 3 shown as an extruded metal shape mounted to the glass panel. As shown in FIG. 4, for example, support apparatus 100 (or 200) may comprise a linkage 130 comprising arms 140, 150 operable to support item 4 (e.g., a plant container) on support body 2 and railing 3 and maintain a generally horizontal orientation of item 4 relative to the ground. Aspects of linkage 130 may be adjustable to accommodate different types of attachments to different types of barrier structures 1, making it easy to level and support heavy items 4 like plant containers in a reliable manner. As shown in FIGS. 4, 5, and 6, for example, aspects of linkage 130 may be adjusted to accommodate different dimensions and cross-sectional shapes of different barrier structures 1, making shelving system 10 easily adapted to support different types of items 4 on different types of barrier structures 1.

Aspects of the present disclosure are now described with reference to shelving apparatus 100 of FIG. 1 and elements in the 100 series of numbers, although similar aspects could be described with reference to shelving apparatus 200 of FIG. 1 and elements in the 200 series of numbers. As shown in FIG. 1, for example, shelving apparatus 100 may comprise: an upward attachment 110; a frame 120; a linkage 130; a downward attachment 160; and/or an extendable retaining arm 170. As shown in FIGS. 1-14, for example, each element of shelving apparatus 100 may be constructed from any combination of metallic, polymeric, and/or wooden materials using any known manufacturing methods, including any known fabrication techniques (e.g., metal or wood working), rapid prototyping (e.g., laser or waterjet cutting), and/or additive manufacturing methods (e.g., 3D printing). Different elements may be made with different methods.

Figure 2:
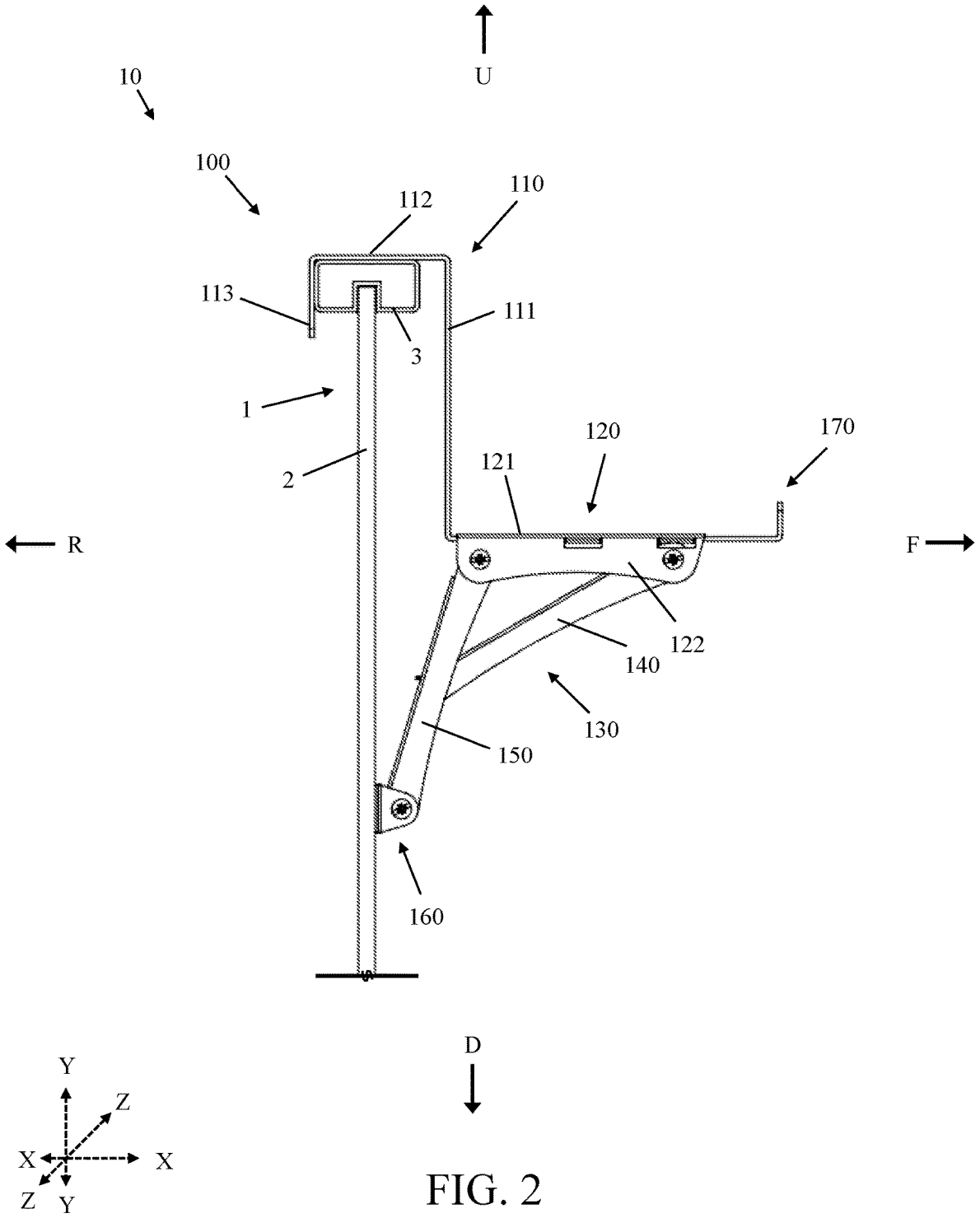
FIG. 2 depicts a side view of an exemplary shelving apparatus on a barrier structure.
Figure 3:
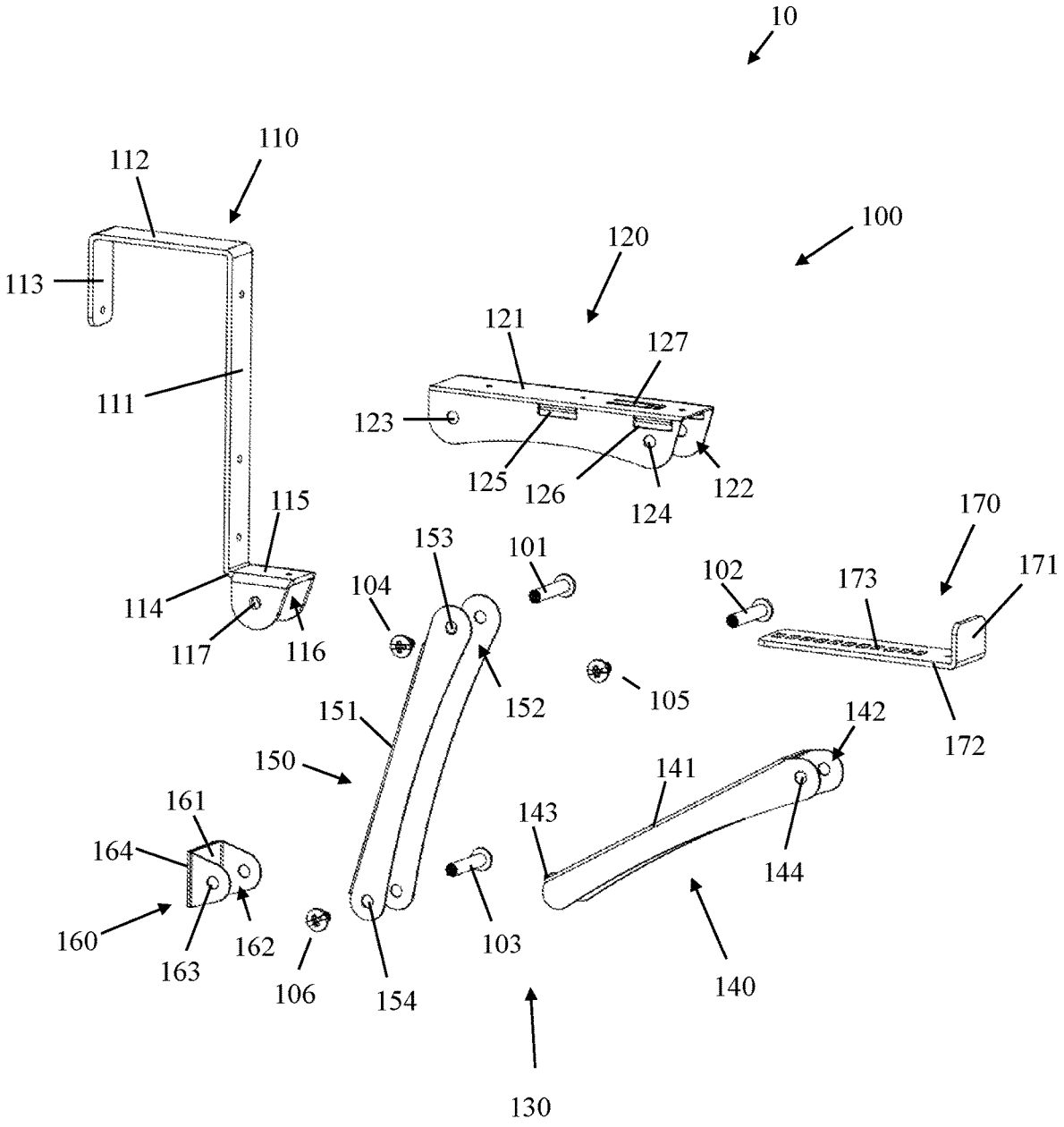
FIG. 3 depicts an exploded view of the FIG. 2 shelving apparatus.

Upward attachment or hook portion 110 and frame 120 may be removably attached together or integrally formed as one construct having a unitary body. It may be easier to manufacture shelving apparatus 100 if upward attachment 110 and frame 120 are formed separately, although either configuration is possible. As shown in FIG. 2, for example, upward attachment 110 may comprise a hook shape operable to support a weight of shelving apparatus 100 and item 4 on railing 3. As shown in FIGS. 2 and 3, for example, the hook shape may be manufactured by bending an elongated metal plate shaped to define a vertical portion 111, a horizontal portion 112, and a return portion 113, in which portions 111 and 113 are offset from one another by portion 112 by a horizontal distance equal to or greater than that of a horizontal cross-sectional dimension of railing 3. As shown in FIG. 3, for example, a downward end of vertical portion 111 may comprise a forward projection 114 attached to a pivot base 115 comprising a pair of opposing plates 116 and a hole 117 extending therethrough in a lateral direction.

As shown in FIGS. 2 and 3, for example, frame 120 may comprise an elongated channel with structure elements defining a first or rearward pivot rotatably attachable with support arm 150 and a second or forward pivot rotatably attachable with support arm 150 to permit adjustment of downward attachment 160 relative to upward attachment 110 in a horizontal direction while maintaining an orientation of frame 120 relative to the ground, such as a generally parallel orientation. As shown in FIG. 3, for example, frame 120 may comprise a support 121, a pair of opposing plates 122, rearward openings 123, forward openings 124, rearward tracks 125, forward tracks 126, and a retaining arm locking element 127.

Support 121 may comprise any shape, including the depicted rectangular shape; and any additional attachment elements, such as the depicted openings extending therethrough. As shown in FIG. 3, for example, pair of opposing plates 122 may extend downwardly from support 121 and be curved to remove excess structural materials. Frame 120 may be a flat metallic plate that is cut from a source material (e.g., a metal plate) with a laser or waterjet and bent to define support 121 and pair of opposing plates 122. Rearward openings 123 may define the first or rearward pivot and forward openings 124 may define the second or rearward pivot. As shown in FIG. 3, for example, rearward openings 123 and forward openings 124 may comprise circular openings extending through plates 122 in a lateral direction. As shown in FIG. 3, for example, rearward openings 123 may locate the first pivot adjacent a rearward end of frame 120 and forward openings 124 may locate the second pivot adjacent a forward end of frame 120, such that the first and second pivots are horizontally spaced apart from one another by a first offset distance.

Figure 12:
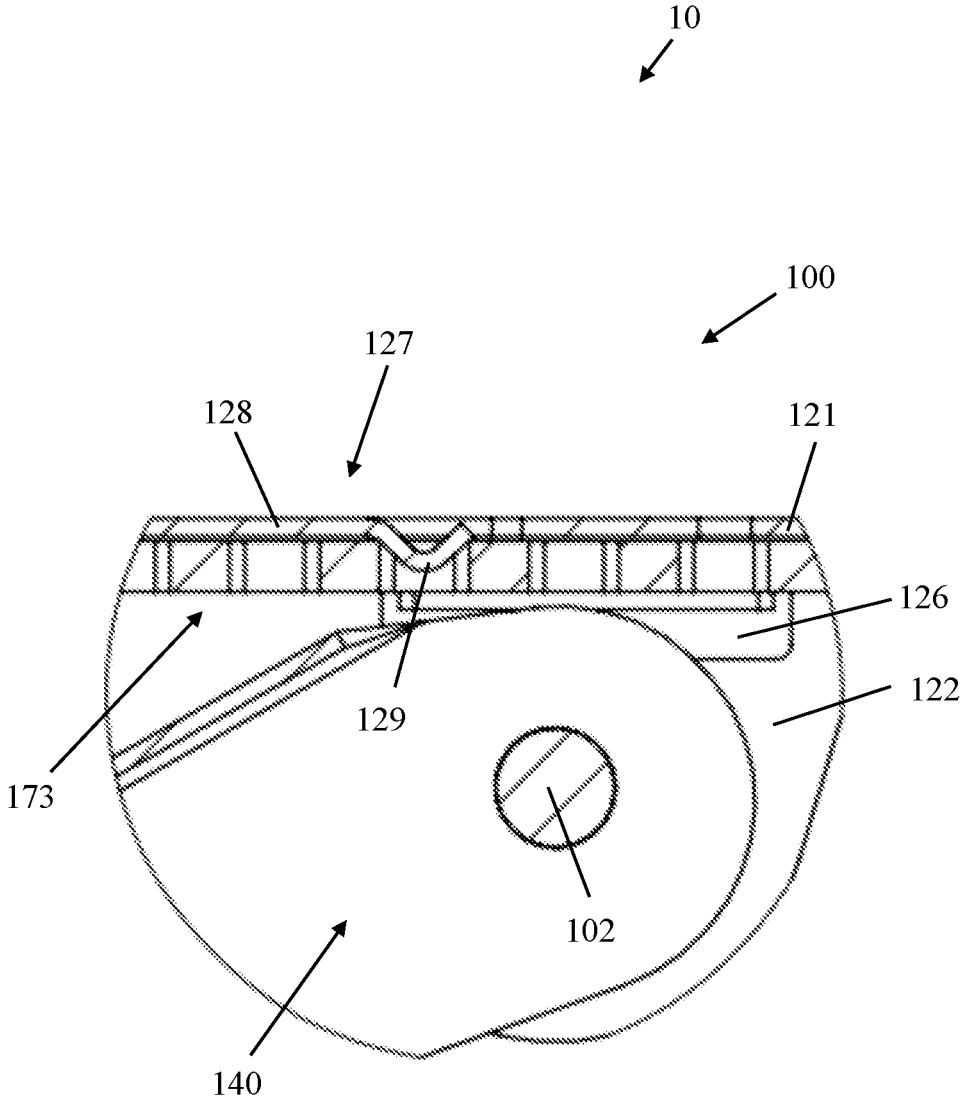
FIG. 12 depicts an enlarged portion of the FIG. 7 cross-sectional view.

Rearward tracks 125 and forward tracks 126 may comprise rectangular openings extending through plates 122 in a lateral direction and rectangular projections extending between plates 122 in the lateral direction. As shown in FIG. 3, for example, rearward tracks 125 may be adjacent a center of frame 120 and forward tracks 126 may be adjacent a forward end of frame 120, such that tracks 125 and 126 are spaced apart from one another in a horizontal direction. As shown in FIG. 12, for example, tracks 125 and 126 may be formed by laser or waterjet cutting downward facing U-shapes into the side of plates 122 and pushing the interior of the U-shapes inwardly to define the rectangular projections. A total of four rectangular projections may be formed this way, providing four upward facing supports extending between pair of opposing plates 122 to define a generally rectangular sliding area between the underside of support 121 and the upward facing supports of tracks 125 and 126.

Figure 9:
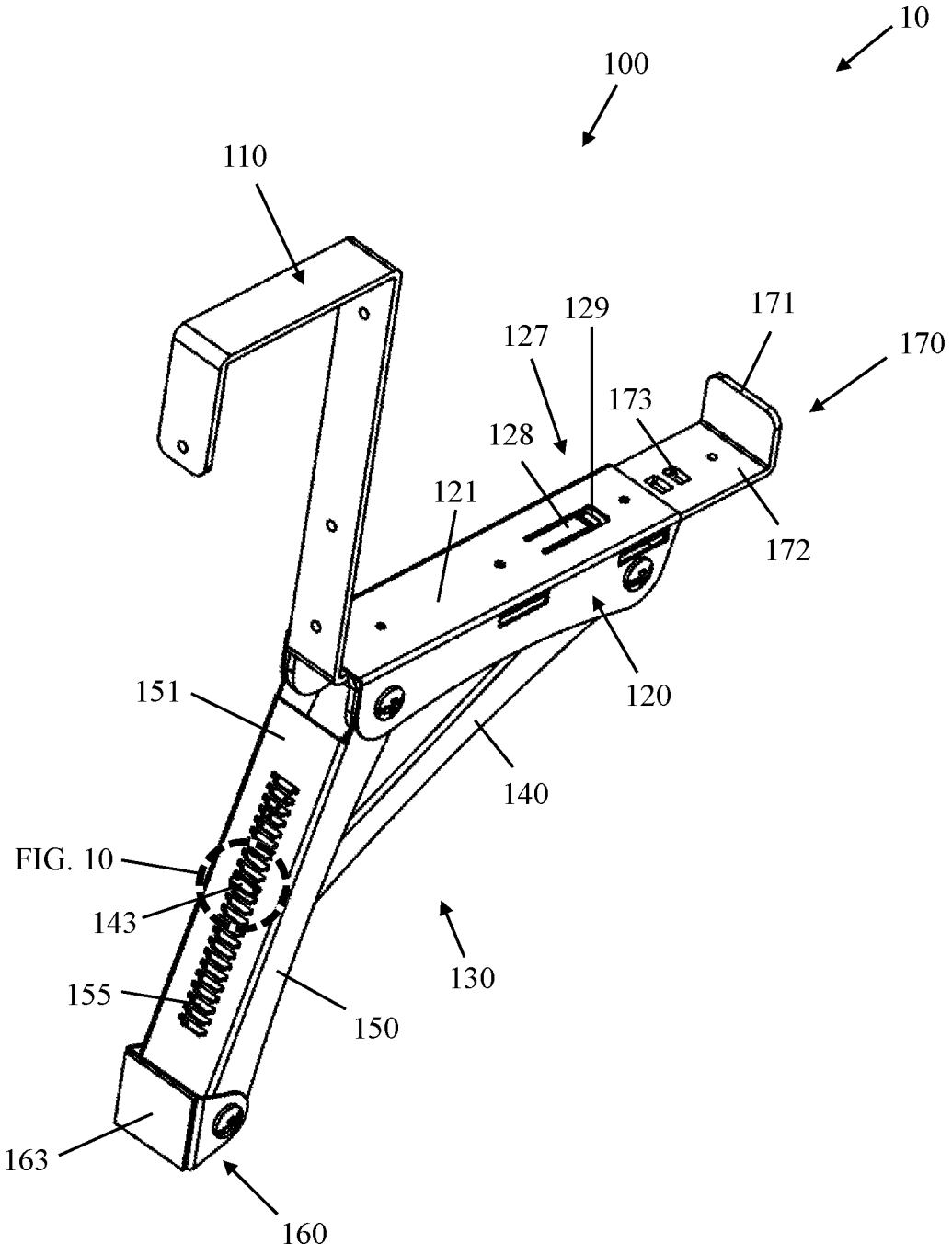
FIG. 9 depicts a rearward perspective view of the FIG. 2 shelving apparatus.
Figure 11:
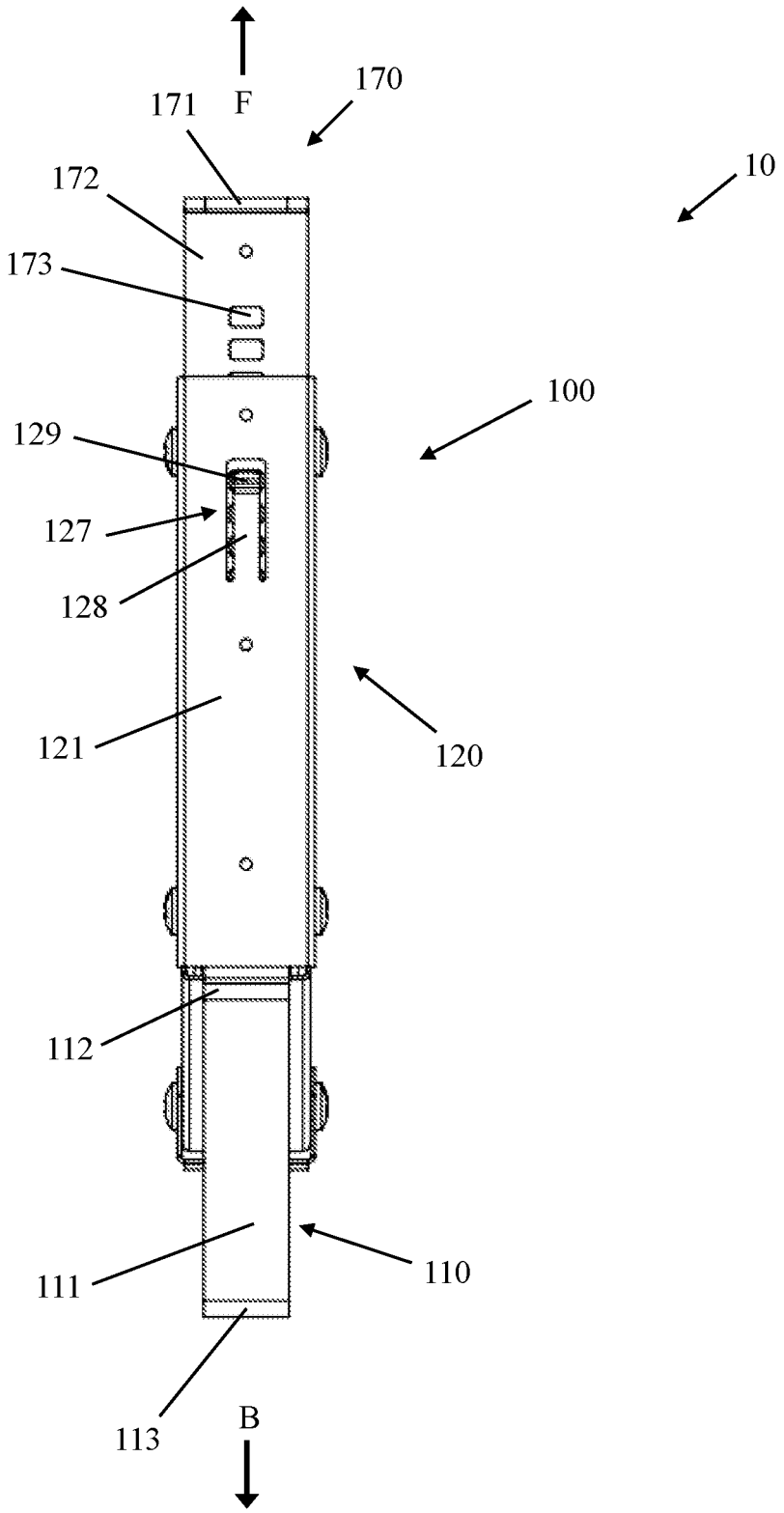
FIG. 11 depicts a downward view of the FIG. 2 shelving apparatus.

Retaining arm locking element 127 may be operable to maintain a position of extendable retaining arm 170 relative to frame 120. As shown in FIGS. 9, 11, and 12, for example, retaining arm locking element 127 may comprise a biasing arm 128 and a detent 129. Similar to above, locking element 127 may be formed by laser or waterjet cutting a downward facing U-shape into support 121 so that a rearward end of biasing arm 128 is integral with frame 120 and a forward end of biasing arm 128 is free to move independently of frame 120. As shown in FIGS. 11 and 12, for example, the forward end of biasing arm 128 may be bent to form detent 129, which is then cantilevered and biased downwardly by arm 128.

Linkage 130 may comprise arms that are rotatably attachable with frame 120 (directly or indirectly) and selectively attachable with one another to maintain different angles of support 121 relative to the ground by transferring forces to a downward portion of barrier structure 1 such as support body 2. As shown in FIG. 1, for example, linkage 120 may comprise a first or adjustment arm 140 and a second or support arm 150. An exemplary configuration of the arms is now described to illustrate the functional capabilities of linkage 130, including its ability to easily level support 121 and accommodate different barrier structures 1.

As shown in FIGS. 1 and 3, for example, adjustment arm 140 may comprise an elongated channel with structure elements that are rotatably attachable to frame 120 and fixedly attachable to support arm 150 in order to permit horizontal adjustments of downward attachment 160 relative to upward attachment 110 while maintaining an orientation of frame 120 relative to the ground. As shown in FIG. 3, for example, adjustment arm 140 may comprise a connector plate 141, a pair of opposing plates 142, a rearward projection 143, and forward openings 144.

Figure 8:
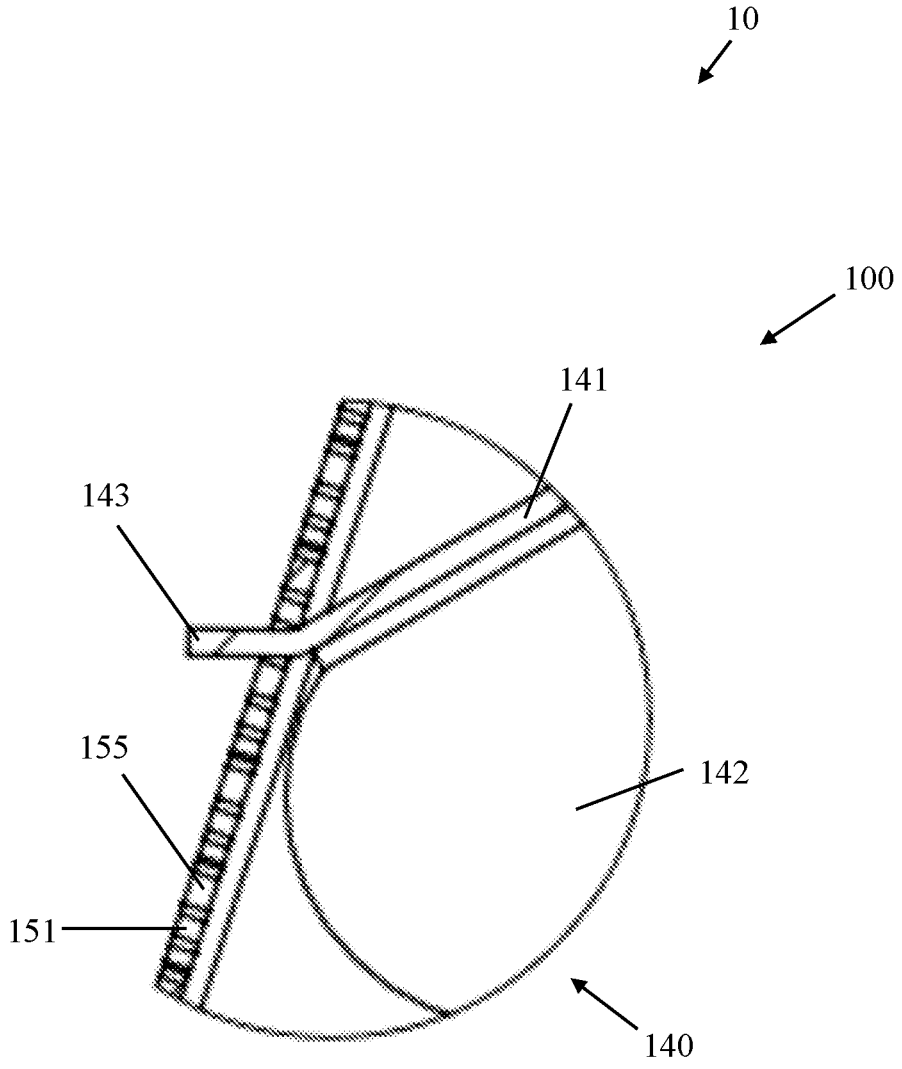
FIG. 8 depicts an enlarged portion of the FIG. 7 cross-sectional view.
Figure 10:
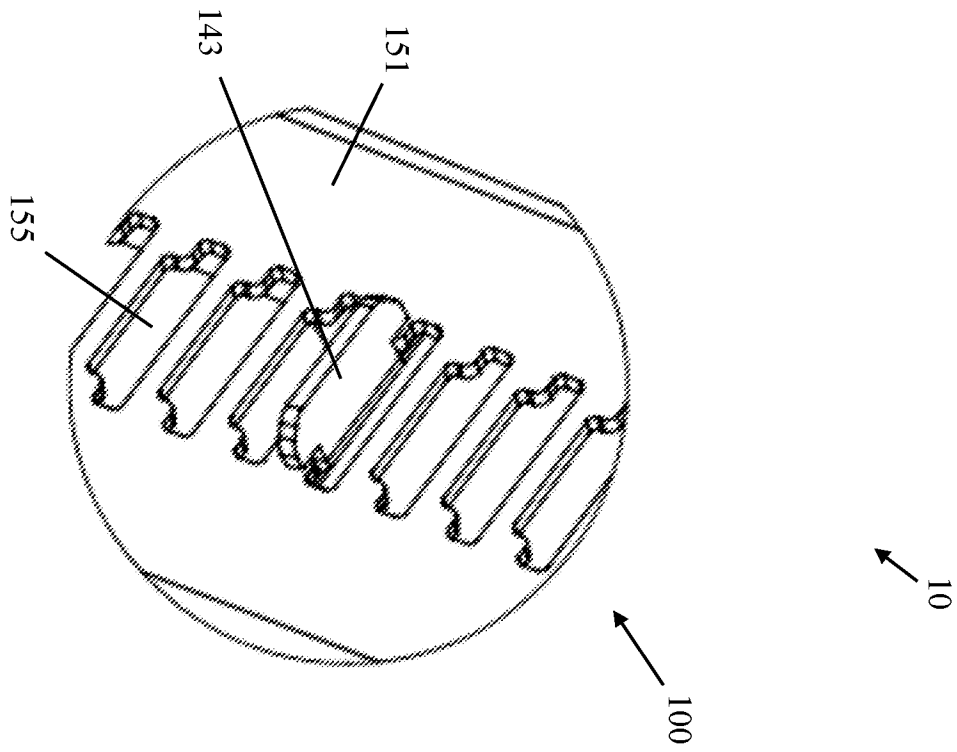
FIG. 10 depicts an enlarged portion of the FIG. 7 perspective view.

Connector plate 141 may have any shape, including the depicted rectangular shape. As shown in FIG. 3, for example, pair of opposing plates 142 may extend downwardly from connector plate 141 and be curved to remove excess structural materials. Similar to frame 120, adjustment arm 140 also may be a flat metallic plate that is cut from a source material (e.g., the same metal sheet noted above) with a laser or waterjet and bent to define connector plate 141 and pair of opposing plates 142. As shown in FIG. 8, for example, a rearward-most end of connector plate 141 may be bent away from adjustment arm 140 to define rearward projection 143. As shown in FIG. 10, for example, rearward projection 143 may comprise a T-shape having flanges and a neck portion extending outwardly from the remainder of connector plate 141. Forward openings 144 may comprise circular openings extending through opposing plates 142 in a lateral direction. As shown in FIG. 3, for example, rearward projection 143 may be at the rearward-most end of adjustment arm 140 and forward openings 144 may be adjacent a forward end of adjustment arm 140, such that projection 143 and openings 144 are spaced apart from one another by a second offset distance.

As also shown in FIGS. 1 and 3, for example, support arm 150 may comprise an elongated channel with structural elements that are rotatably attachable to upward attachment 110, frame 120, and adjustment arm 140 in order to permit horizontal adjustments of downward attachment 160 relative to upward attachment 110 while maintaining an orientation of frame 120 relative to the ground. As shown in FIG. 3, for example, support arm 150 may comprise an interface plate 151, a pair of opposing plates 152, upward openings 153, and downward openings 154.

Interface plate 151 may comprise any shape, including the depicted rectangular shape. As shown in FIGS. 9 and 10, for example, interface plate 151 may comprise a plurality of openings 155 extending therethrough in a horizontal direction. As shown in FIG. 10, for example, each opening of plurality of openings 155 may comprise a keyed shape comprising a first or upward portion sized to receive the entire T-shape of rearward projection 143, including the flanges and a neck portion; and a second or downward portion sized to receive only the neck shape. This configuration allows rearward projection 143 to be securely and removably attached to interface plate 151 at a plurality of different locations along the length of plate 151 by inserting the neck portion of rearward projection 143 in downward portion of different openings 155, making it easy to adjust relative angles between frame 120, adjustment arm 140, and support arm 150.

As shown in FIG. 3, for example, pair of opposing plates 152 may extend downwardly from interface plate 151 and be curved to remove excess structural materials. Similar to frame 120 and adjustment arm 140, support arm 150 also may be a flat metallic plate that is cut from a source material (e.g., the same metal sheet) with a laser or waterjet and bent to define interface plate 151 and pair of opposing plates 152. Upward openings 153 and forward openings 154 may comprise circular openings extending through plates 152 in a lateral direction. As shown in FIG. 3, upward openings 153 may be adjacent an upward end of support arm 150 and downward openings 154 may be adjacent a downward end of support arm 150, such that openings 153 and 154 are horizontally spaced apart from one another by a third distance.

Downward attachment 160 may comprise structural elements that are rotatably attachable to support arm 150 in order to accommodate different types of barrier structures 1. As shown in FIG. 3, for example, downward support portion 160 may comprise a back plate 161, a pair of opposing ears 162, openings 163, and a barrier contact surface 164. Pair of opposing ears 162 may extend downwardly from back plate 161 and be curved to remove excess structural materials. Similar to above, downward support portion 160 also may be a flat metallic plate that is cut from a source material (e.g., the aforementioned metal sheet) with a laser or waterjet and bent to define back plate 161 and pair of opposing ears 162. Openings 163 may comprise circular openings extending through opposing ears 162 in a lateral direction.

Barrier contact surface 164 may be configured to establish a friction and/or suction fit with support body 2 of barrier structure 1. As shown in FIGS. 1 and 2, for example, support body 2 may comprise a glass panel and barrier contact surface 164 may comprise a surface coating and/or treatment that is applied and/or attached to barrier contact surface 164 for the purpose of maintaining a vertical and rotational position of downward support portion 160 relative to support body 2. The coating and/or treatment may have material properties configured to enhance a coefficient of friction between support body 2 and barrier contact surface 164 and/or provide an adhesive connection therebetween. Barrier contact surface 164 also may comprise any known technologies for attaching downward support portion 160 to support body 2 without damaging it, including suction cups and like technologies. As shown in FIG. 1, for example, contact surface 164 may be non-marking on glass panels like support body 2 depicted therein.

Extendable retaining arm 170 may be slidably attachable to frame 120 and operable to extend support 121 in a horizontal direction so that shelving apparatus 100 may be easily adapted to accommodate larger items 4. As shown in FIGS. 3 and 9, for example, extendable retaining arm 170 may comprise a return portion 171, a slide portion 172, and a plurality of openings 173. Similar to upward attachment 110, extendable retaining arm 170 may comprise an elongated metal plate shaped to define return portion 171 and slide portion 172. Plurality of openings 173 may extend through slide portion 172 in a vertical direction.

Additional aspects of assembling and operating shelving apparatus 100 are now described.

As shown in FIG. 3, for example, pivot base 115 may be fixedly attached (e.g., welded) to forward projection 114. The upward end of support arm 150 may be placed over pivot base 115 to align openings 117 and 153 in a lateral direction. The rearward end of frame 120 may then be placed over the upward end of support arm 150 to align openings 117 and 153 with openings 123 in the lateral direction. The first or rearward pivot may thus be formed by inserting a first pivot pin 101 through openings 123, 153, and 117 in the lateral direction and securing pin 101 against external surfaces of frame 120 with a first locking nut 104 so that upward support portion 110, frame 120, and support arm 150 are rotatably attached to one another at the first pivot.

As shown in FIG. 3, for example, the forward end of frame 120 may then be placed over the upward end of adjustable arm 140 to align openings 123 and 144. The second or rearward pivot may thus be formed by inserting a second pivot pin 102 through openings 123 and 144 in the lateral direction and securing pin 102 against external surfaces of frame 120 with a second locking nut 105 so that frame 120 and adjustable arm 140 are rotatably attached to one another at the third pivot. The downward end of support arm 150 may then be placed between pair of opposing ears 162 of downward support portion 160 to align openings 124 and 163. A third or downward pivot may thus be formed by inserting a third pivot pin 103 through openings 124 and 163 in the lateral direction and securing pin 103 against external surfaces of ears 162 with a third locking nut 106 so that support arm 150 and downward support portion 160 are rotatably attached to one another at the third pivot.

At this point, because of the rotatable connections between frame 120, adjustable arm 140, and support arm 150 at the first and second pivot, it is possible to easily adjust a horizontal position of downward attachment 160 relative to upward attachment 110 while maintaining a desired orientation of frame 120 relative to the ground. As shown in FIG. 10, for example, rearward projection 143 may then be inserted into one of plurality of openings 155 to maintain the orientation of frame 120. The selected one of openings 155 may depend on the desired horizontal position of support body 2 relative to railing 3. As shown in FIGS. 2 and 4, for example, support body 2 may be generally aligned with railing 3, in which case rearward projection 143 may be inserted into a middle one of plurality of openings 155 to maintain the orientation of frame 120 relative to the ground. As shown in FIG. 5, for example, support body 2 may be rearward of railing 3, in which case rearward projection 143 may be inserted into an upward one of plurality of openings 155 to maintain the orientation of frame 120 relative to the ground. As shown in FIG. 6, for example, support body 2 may be forward of railing 3, in which case rearward projection 143 would be inserted into a downward one of plurality of openings 155 to maintain the orientation of frame 120.

Rearward projection 143 may thus be selectively inserted into different ones of plurality openings 155 to achieve and maintain different angles of frame 120 relative to the ground, making it easy to level and/or position item 4 on support body 121. Put another way, once assembled as described herein, shelving apparatus 100 may comprise: (i) frame 120 comprising upward attachment 110 operable to transfer first forces to an upward portion of barrier structure 1, a first pivot adjacent upward attachment 110, a second pivot spaced apart from upward attachment 110, and support 121 extending between the first pivot and the second pivot; (ii) support arm 150 comprising a first end rotatably attachable with the first pivot and a second end comprising a downward attachment operable to transfer second forces to a downward portion of barrier structure 1; and (iii) adjustment arm 140 comprising a first end rotatably attachable with the second pivot and a second end removably attachable with different portions of support arm 150 to maintain different angles of support 121 relative to the ground by balancing components of the first forces against components the second forces, in which support arm 150 and adjustment arm 140 are operable to move downward attachment 160 between positions forward and rearward of upward attachment 110.

The range of motion depicted in FIGS. 4, 5, and 6 makes it possible for shelving apparatus 100 to accommodate the respective geometries of many different types of barrier structures, including the glass barrier depicted in FIG. 4, the decorative concrete barrier depicted in FIG. 5, and the separated metal barrier depicted in FIG. 6, just to name a few. Any type, size, or shape of barrier structure 1 may be similarly accommodated by shelving apparatus 100 (or 200), making aspects of shelving system 10 deployable in a wide variety of circumstances for a wide variety of uses. For example, once assembled as described herein, shelving apparatus 100 may comprise: (i) a frame 120 comprising upward attachment 110 operable to transfer first forces to an upward portion of barrier structure 1 (e.g., railing 3) and support 121 extending outwardly from upward attachment 110; and (ii) linkage 130 comprising arms (e.g., first arm 140 and second arm 150) and downward attachment 160 removably attachable to a downward portion of barrier structure 1 (e.g., support body 2), the arms being: (i) attachable with frame 120 and one another to maintain different angles of support 121 relative to the ground by transferring forces to the downward portion of barrier structure 1 with downward attachment 160; and (ii) operable to move downward attachment 160 in a range of motion between positions forward and rearward of upward attachment 110 to accommodate different dimensions of different barrier structures 1.

Aspects of linkage 130 and/or the arms described in relation thereto, such as adjustment arm 140 and support arm 150, may be modified to realize the described its range of motion. As shown in FIG. 1, for example, a first one of the arms (e.g., support arm 150) may be rotatably attached to the first pivot of frame 120 and a second one of the arms (e.g., adjustment arm 140) may be rotatably attached to the second pivot of frame 120 and removably attached to the first one of the arms (e.g., to arm 150). Alternatively, without departing from this disclosure, the second one of the arms (e.g., adjustment arm 140) may be rotatably attached to the first one of the arms (e.g., to pivot pin extending therethrough) and removably attachable the second pivot of frame 120 (e.g., using a forward projection similar to rearward projection 143). In this respect, descriptive terms like "adjustable"

and "support" are used in reference to the arms of linkage 30 for ease of description and not intended as limitations unless claimed as such.

The respective first, second, and third offset distances described above may modified as needed to enhance the range of motion for linkage 130. As shown in FIG. 1, for example, the first offset distance may shorter than the second offset distance which may be equal to and/or shorter than the third offset distance, variations of which may be utilized to expand the range of motion.

As shown in FIG. 3, for example, slide portion 172 of extendable retaining arm 170 may be inserted into the generally rectangular sliding area between the underside of support 121 and the upward facing supports of tracks 125 and 126, making it possible to move return portion 171 of extendable retaining arm 170 in a rearward and/or forward direction relative to frame 120. As shown in FIG. 12, for example, a rearward or forward position of return portion 171 may be selectively maintained by removably attaching detent 129 with one of plurality of openings 173, in which detent 129 is pushed into each opening 173 with a downward biasing force applied by biasing arm 128 as slide portion 172 is moved into its final position.

Figure 13:
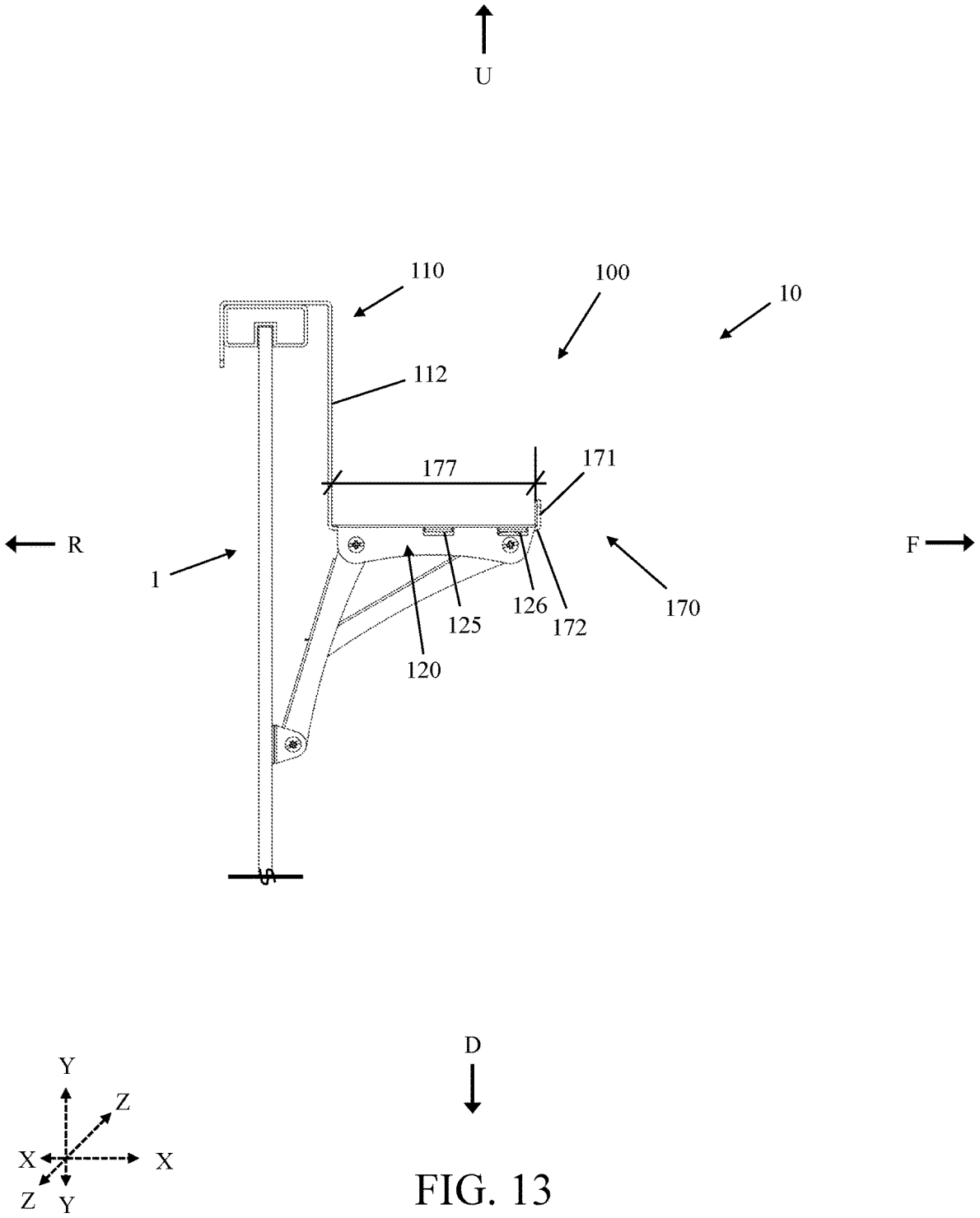
FIG. 13 depicts a side view of the FIG. 2 shelving apparatus with an extendable retaining arm in a retracted position.
Figure 14:
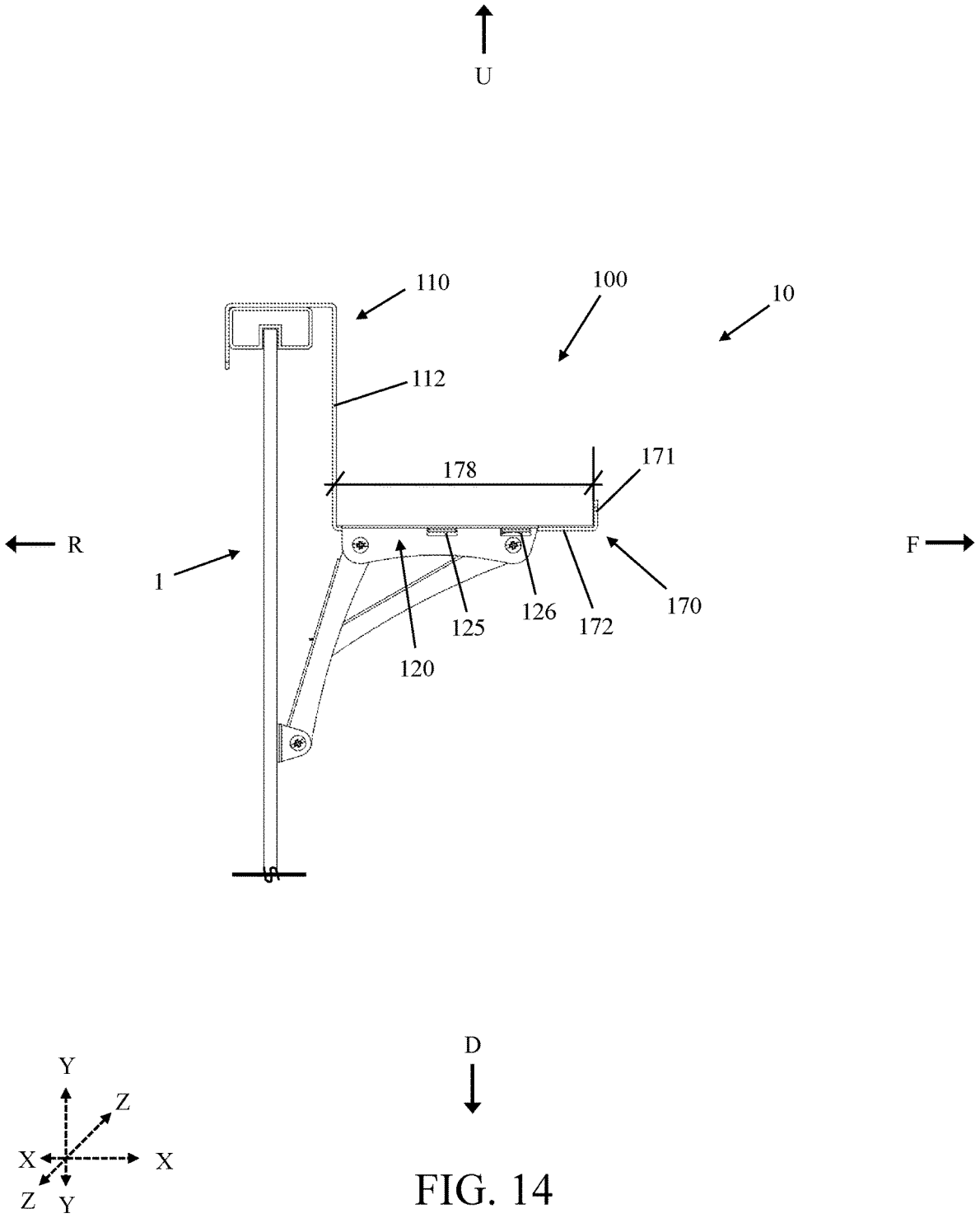
FIG. 14 depicts a side view of the FIG. 2 shelving apparatus with the extendable retaining arm in an extended position.

As shown in FIG. 13, for example, a minimum distance 177 between interior surfaces of vertical portion 111 of upward attachment 110 and interior surfaces of return portion 171 of extendable retaining arm 170 may be maintained by removably placing detent 129 in a forward-most one of openings 173. As further shown in FIG. 13, for example, a maximum distance 178 between interior surfaces of vertical portion 111 of upward attachment 110 and interior surfaces of return portion 171 of extendable retaining arm 170 may be maintained by removably placing detent 129 in a rearward-most one of openings 173.

As shown in FIG. 1, for example, system 10 may utilize shelving apparatus 100 and shelving apparatus 200 to support an elongated item 4 (e.g., a planter box) and/or a shelf structure (e.g., a wooden board) configured to support a plurality of items 4 (e.g., multiple planters). Because of the structural and functional characteristics described herein, an orientation of any item 4 relative to the ground may be easily maintained by moving rearward projection 143 into one of openings 155 and precisely adjusted by moving projection 143 into a different one of openings 155.

As shown in FIGS. 1-14, for example, a plurality of shelving apparatus 100 (or 200) may be vertically connected to one another by removably attaching the upward attachment 110 of one shelving apparatus 100 to the downward attachment 160 of another apparatus 100 to provide multiple levels of shelving. Aspects of either portion 110 and/or 160 may be modified to permit the attachment, making possible to add shelving to any type of structure.

Any portion of shelving apparatus 100 and/or 200 may be rubber dipped or have a simple plastic sleeve installed onto it to prevent damage to barrier structure 1.

Figure 15:
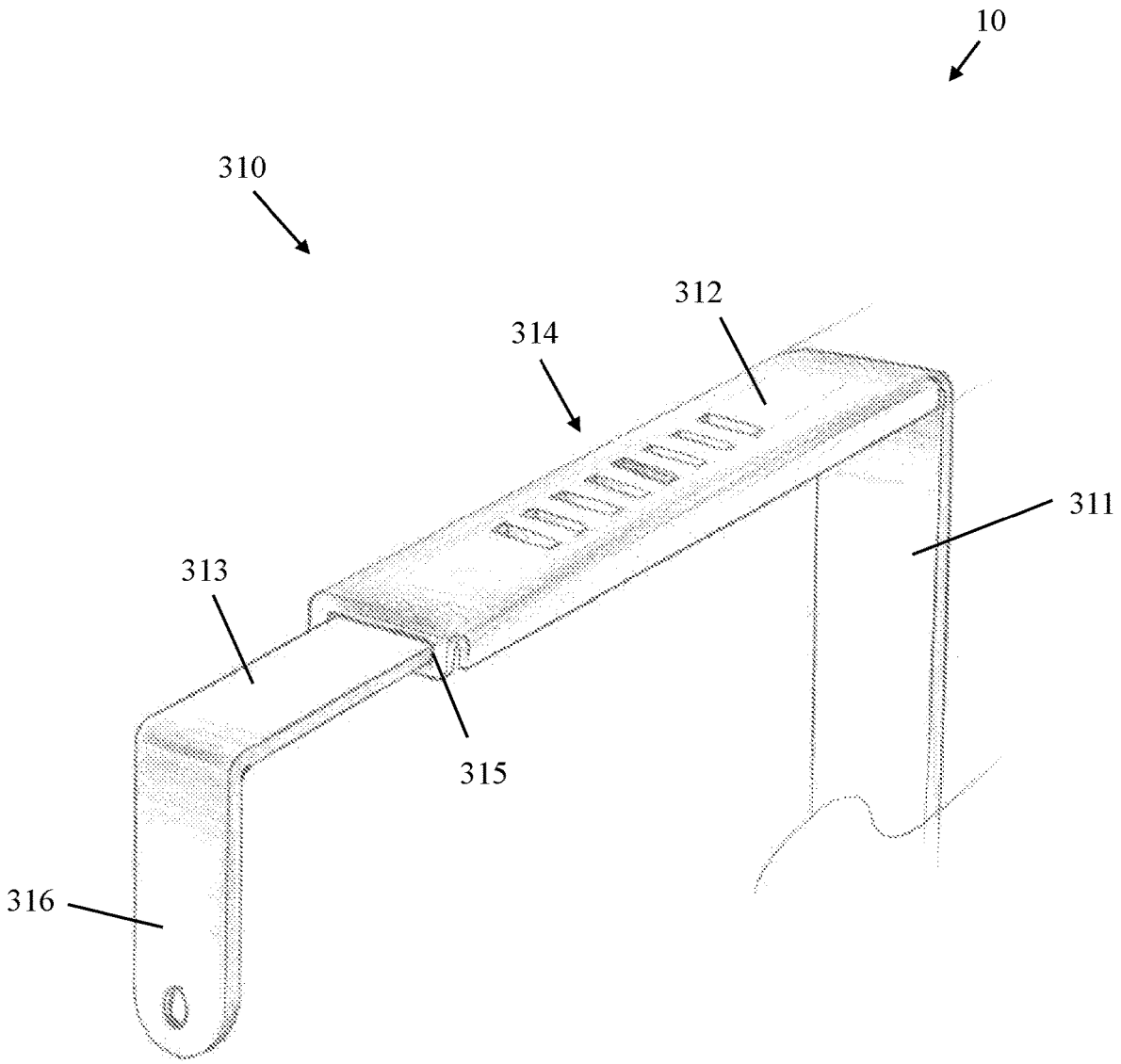
FIG. 15 depicts a perspective view of an exemplary upward attachment for a shelving apparatus.

Other portions of shelving apparatus 100 and/or 200 may be selectively adjustable in keeping with this disclosure, including exemplary alternative upper attachment 310 now described with reference to FIGS. 15, 16, and 17. Upper attachment 310 may provide a support function equal to that of upper attachment 110, but with an additional degree of horizontal adjustability for accommodating different dimensions of different upward portions (e.g., such as railing 3) of different barrier structures. As shown in FIG. 15, for example, upper attachment 310 may comprise a vertical portion 311, a forward connecting portion 312, and a rearward connecting portion 313.

In keeping with above, forward connecting portion 312 may be a flat metallic plate that is cut from a source material (e.g., the aforementioned metal plate) with a laser or waterjet and bent to define vertical portion 311 and forward connecting portion 312. Vertical portion 311 may be similar to vertical portion 111 of FIG. 2. For example, vertical portion 311 may similar be attached to or formed integral with support 121 described above with reference to shelving apparatus 100.

Forward connecting portion 312 may comprise a plurality of connector openings 314 and a receiving opening 315. As shown in FIGS. 16 and 17, for example, plurality of connecting openings 314 may comprise rectangular shapes extending vertically through a horizontal body of forward connecting portion 312 at locations spaced apart horizontally. As shown in FIGS. 16 and 17, the body of forward connecting portion 312 may comprise a rearward tab bent into a generally vertical orientation and receiving opening 315 may extend through the rearward tab in a generally horizontal direction, thereby aligning opening 315 with a longitudinal axis of forward connecting portion 312. Additional side tabs may extend downwardly from the body of forward connecting portion 312. Receiving opening 315 may comprise a rectangular shape sized to receive a corresponding rectangular shape of rearward connecting portion 313. As shown in FIGS. 16 and 17, receiving opening 315 may comprise any partially or fully enclosed shape providing one or more upward facing supports extending through the tab of forward connecting portion 312 to define a generally rectangular sliding area extending horizontally between interior surfaces of opening 315 and the additional side tabs of forward connecting portion 312.

Figure 16:
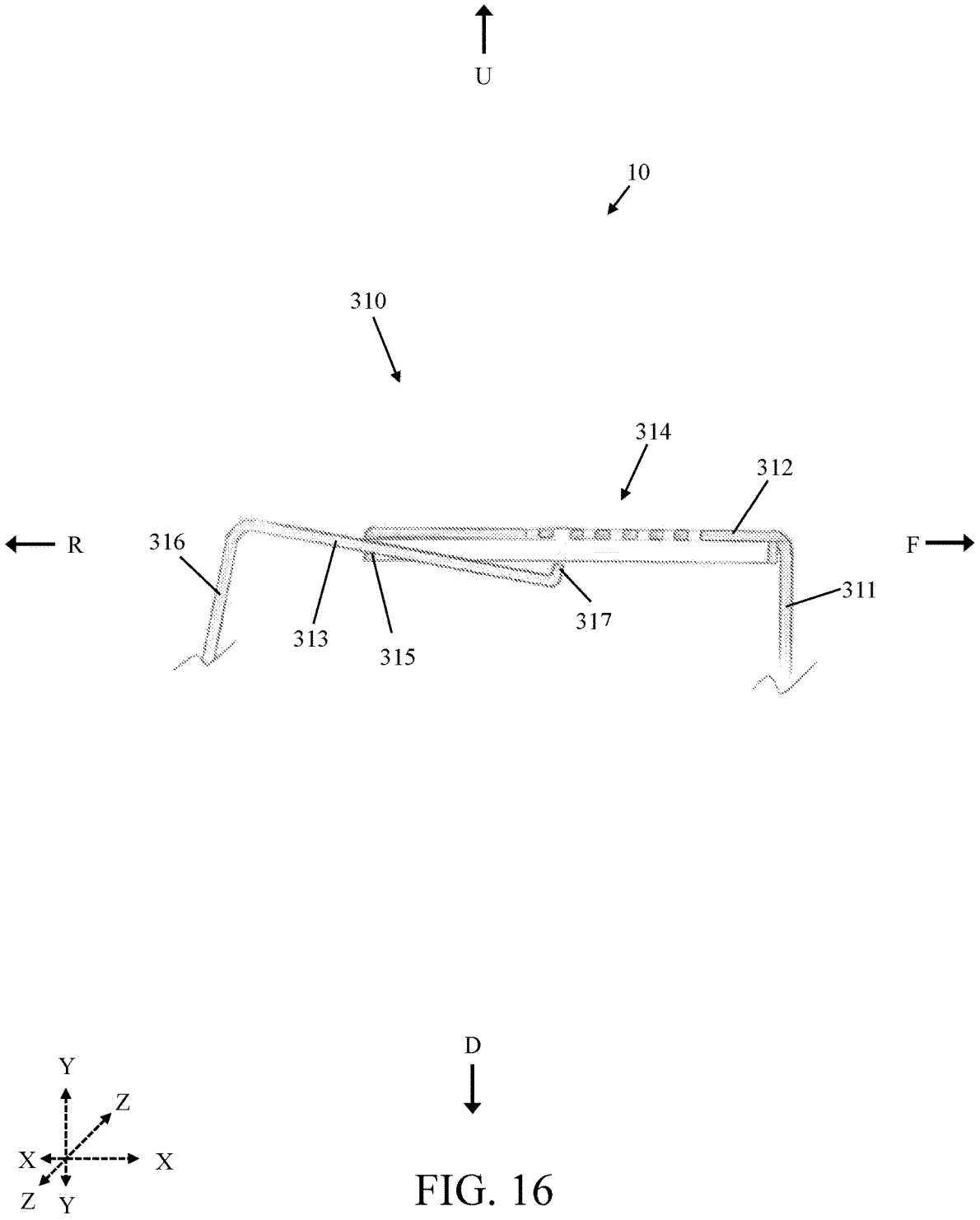
FIG. 16 depicts a cross-sectional view of the FIG. 15 attachment in an open configuration.
Figure 17:
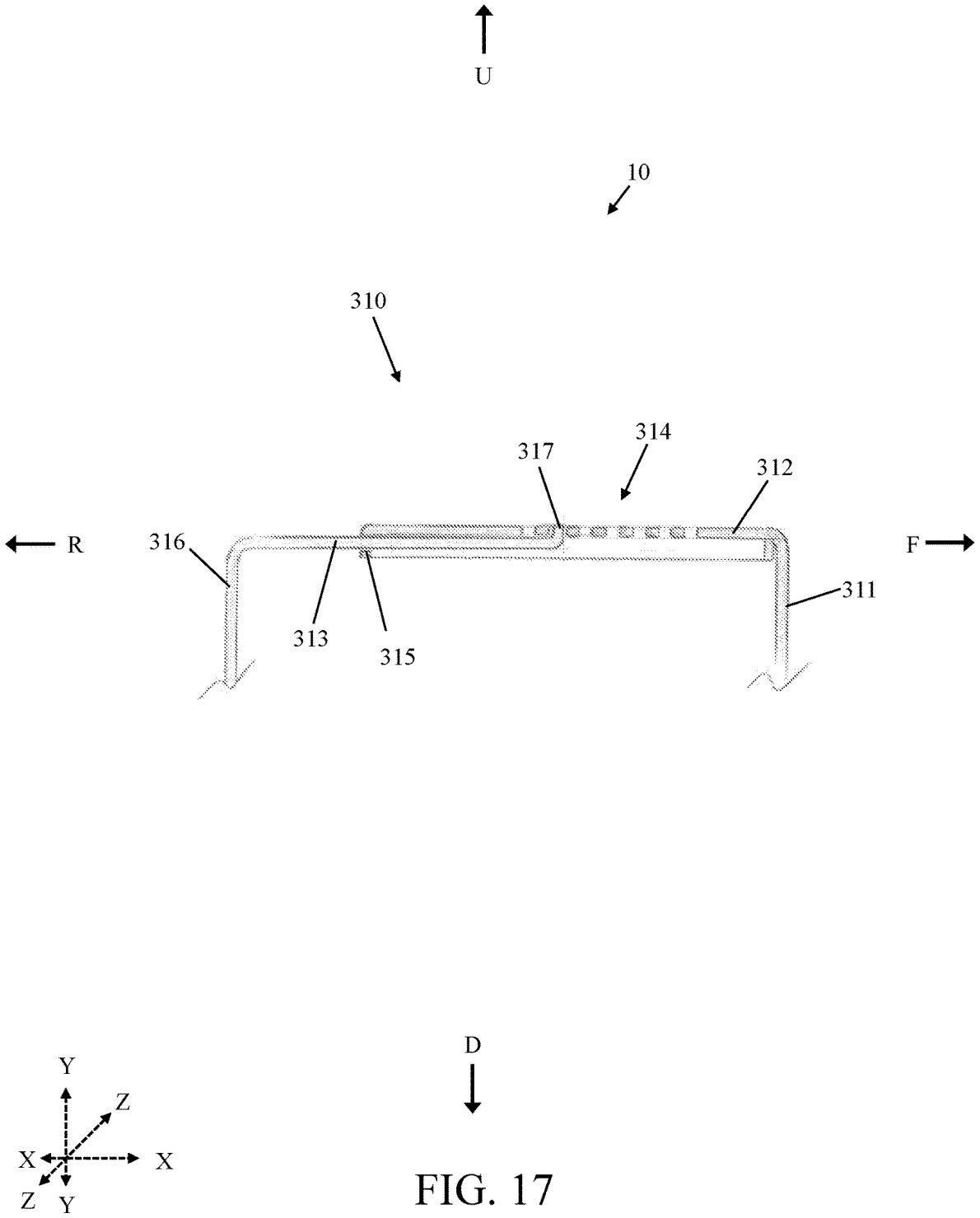
FIG. 17 depicts a cross-sectional view of the FIG. 15 attachment in a closed configuration.

As shown in FIGS. 16 and 17, for example, rearward connecting portion 313 may comprise a return portion 316 and a connector tip 317. Return portion 316 may be similar to return portion 113 shown in FIG. 2 and described above. For example, rearward connecting portion 313 may be manufactured by bending an elongated metal plate to define a horizontal portion extending between return portion 316 and connector tip 317. Connector tip 317 may be bent and shaped for receipt in receiving opening 315 and one opening of plurality of openings 314. As shown in FIG. 16, for example, the rectangular cross-section of connector tip 317 may be aligned with the rectangular cross-section of receiving opening 315 so that rearward connecting portion 313 may be moved relative to forward connecting portion 312 as needed to move connector tip 317 through opening 315 and into the open configuration shown in FIG. 16, in which tip 17 is positioned adjacent a desired one of plurality of openings 314. Rearward connecting portion 313 may then be rotated on the interior surfaces of receiving opening 315 to move connector tip 317 into the locked configuration shown in FIG. 17, in which tip 17 is positioned inside of the desired opening 314 to removably attach rearward connecting portion 313 to forward connecting portion 312.

Once rearward connecting portion 312 has been removably attached to forward connecting portion 312, upward attachment 310 may be operable as shown in FIG. 2 with reference to upward attachment 110. A friction fit between connector tip 317 and the desired opening 314 may prevent portions 312 and 313 from moving relative to one another. Similar to as shown in FIG. 2, for example, any gravity forces applied to shelving apparatus 10 by item 4 may be utilized to maintain upward attachment 310 in the locked configuration shown in FIG. 17 by applying reaction forces operable to push connector tip 317 into the desired opening 314.

While principles of the present disclosure are described herein with reference to illustrative aspects for particular applications, the disclosure is not limited thereto. Those having ordinary skill in the art and access to the teachings provided herein will recognize additional modifications, applications, aspects, and substitution of equivalents all fall in the scope of the aspects described herein. Accordingly, the present disclosure is not to be considered as limited by the foregoing description.

The invention claimed is:

1. A shelving apparatus, comprising:

a frame comprising an upward attachment removably attachable to an upward portion of a barrier structure and a support extending outwardly from the upward attachment; and a linkage comprising arms and a downward attachment removably attachable to a downward portion of the barrier structure, the arms being attachable with the frame and one another to maintain different angles of the support relative to the ground by transferring forces to the downward portion of the barrier structure with the downward attachment; and operable to move the downward attachment in a range of motion between positions forward and rearward of the upward attachment to accommodate different dimensions of different barrier structures.

2. The apparatus of claim 1, wherein the upward attachment comprises a vertical portion extending between a hook portion and a first pivot.

3. The apparatus of claim 2, wherein the hook portion defines an open shape that wraps at least partially around the upward portion of the barrier structure.

4. The apparatus of claim 3, wherein the open shape comprises a rectangular shape.

5. The apparatus of claim 3, wherein the hook portion comprises a horizontal portion extending rearwardly from the vertical portion and a return portion extending vertically from the horizontal portion; and the open shape is defined by interior surfaces of the horizontal and return portions.

6. The apparatus of claim 5, wherein the horizontal portion is removably attachable to the vertical portion and operable to modify an interior dimension of the open shape.

7. The apparatus of claim 6, wherein the horizontal portion comprises a forward connecting portion including the vertical portion; and a rearward connecting portion including the rearward portion; and the forward connecting portion is removably attachable to the rearward connecting portion.

8. The apparatus of claim 7, wherein the forward connecting portion is selective operable with the rearward connection portion to maintain the interior dimension of the open shape by locking the rearward connecting portion onto the forward connecting portion.

9. The apparatus of claim 8, wherein the forward connecting portion comprises a plurality of connector openings and the rearward connection portion comprises a connector tip that is receivable in one opening of the plurality of openings to lock the rearward connecting portion onto the forward connecting portion.

10. The apparatus of claim 1, wherein the upward attachment and the frame are formed integrally with one another.

11. The apparatus of claim 10, wherein the frame comprises a first pivot adjacent the upward attachment and a second pivot spaced apart from the upward attachment; and the support extends between the first pivot and the second pivot.

12. The apparatus of claim 11, wherein a first one of the arms is rotatably attached to the first pivot.

13. The apparatus of claim 12, further comprising a first pivot pin extending through the first pivot and the first one of the arms.

14. The apparatus of claim 12, wherein a second one of the arms is rotatably attached to the second pivot and removably attached to the first one of the arms.

15. The apparatus of claim 14, further comprising a second pivot pin extending through the second pivot and the second one of the arms.

16. The apparatus of claim 12, wherein a second one of the arms is rotatably attached to the first one of the arms and removably attachable the second pivot.

17. The apparatus of claim 11, wherein the arms comprise: a support arm that is rotatably attachable with the first pivot and comprises a downward attachment operable to transfer the second forces to the downward portion of the barrier structure;

and an adjustment arm operable with the frame and the support arm to maintain the different angles of the support relative to the ground.

18. The apparatus of claim 17, wherein an end of the adjustment arm is removably attachable with different portions of the support arm to selectively maintain the different angles of the support relative to the ground.

19. The apparatus of claim 18, wherein the end of the adjustment arm comprises an extension and the different portions of the support arm comprise a plurality of openings that are spaced apart along a length of the support arm and sized to receive the extension.

20. The apparatus of claim 19, wherein the extension comprises a neck that is securable in a narrowed portion of each opening of the plurality of openings.

21. The apparatus of claim 1, wherein one of the arms comprises a downward attachment that is removably attachable to the downward portion of the barrier structure.

22. The apparatus of claim 21, wherein the downward attachment is rotatably engaged with the one of the arms.

23. The apparatus of claim 21, wherein the downward attachment comprises a barrier contact surface operable to transfer the second forces to the downward portion of the barrier structure when the downward attachment is rotated to place the barrier contact surface in a generally parallel alignment with the second portion of the barrier structure.

24. The apparatus of claim 23, wherein the barrier contact surface comprises a material that is non-marking when removably attached to a glass panel.

25. The apparatus of claim 1, wherein the frame comprises a return portion extending upwardly from the support at a location adjacent the second pivot.

26. The apparatus of claim 25, wherein the frame comprises an extendable retaining arm that is selectively operable to adjust a horizontal dimension of the support by selectively moving the return portion relative to the second pivot.

27. The apparatus of claim 26, wherein the frame comprises tracks located downwardly of the support; and the return portion comprises a slide body that is slidable in the tracks to adjust the dimension of the support.

28. A shelving system, comprising a first apparatus and a second apparatus, both according to claim 1.

29. The shelving system of claim 28, wherein an upper attachment of the first apparatus is removably attachable to a lower attachment of the second apparatus.

* * * * *